United States Patent [19]

Hochreutiner

[11] Patent Number: 4,503,410

[45] Date of Patent: Mar. 5, 1985

[54] ELECTROMAGNETIC MINIATURE RELAY

[75] Inventor: Roger M. Hochreutiner, Lieli, Switzerland

[73] Assignee: International Standard Electric Corporation, New York, N.Y.

[21] Appl. No.: 501,934

[22] Filed: Jun. 7, 1983

[30] Foreign Application Priority Data

Jun. 10, 1982 [CH] Switzerland ..... 3579/82

[51] Int. Cl.[3] ..... H01H 1/66

[52] U.S. Cl. ..... 335/153; 335/154; 335/196

[58] Field of Search ..... 335/151, 152, 153, 154, 335/162, 163, 196, 205, 206, 207

[56] References Cited

U.S. PATENT DOCUMENTS 3,629,749 12/1971 Woodhead ..... 335/196

3,869,685 3/1975 Buttel et al. ..... 335/196

FOREIGN PATENT DOCUMENTS 1341671 12/1973 United Kingdom ..... 335/196

*Primary Examiner*—George Harris

*Attorney, Agent, or Firm*—John T. O'Halloran; Jeffrey P. Morris

[57] ABSTRACT

A relay with a contact making independent from environmental conditions with two hermetically sealed contact pills is described. Each contact pill comprises a switching-over contact and a diaphragm made of electrically and magnetically conducting material which diaphragm is the movable member adhering on corresponding contact poles due to the magnetic flux caused by a permanent magnet and flowing through the core of a drive coil. To change the contact condition of the relay it is sufficient to produce a current pulse through the drive coil causing a control flux of a magnitude which exceeds that of the permanent magnet flux by a small amount only because the two fluxes add their strength when the change-over operation is initiated. Due to this adding the needed drive power is so small that a direct driving by TTL-circuits is possible. By other arrangements of the permanent magnet within the magnetic circuit monostable relays can also be realized.

6 Claims, 7 Drawing Figures

ELECTROMAGNETIC MINIATURE RELAY

BACKGROUND OF THE INVENTION

1. Field of the Invention

The present invention relates to an electromagnetic miniature relay including at least one hermetically sealed contact unit with a change-over contact the movable contact of which consists of an elastic ferromagnetic diaphragm and the fixed contacts of which consist of contact poles of ferromagnetic material mounted within pole rings by hermetically sealing and magnetically and electrically insulating connections, the two pole rings and the diaphragm of a contact unit being connected with each other in a magnetically and electrically conducting manner and with the coil core of a drive coil in a magnetically conducting manner, the magnetic circuit being closed via outer elements.

2. Description of the Prior Art

Electromagnetic relays using diaphragm contacts as contact units are known and described in detail, for example, in Swiss Pat. No. 455 941. Contact units of this kind are especially known from Swiss Pat. No. 452 021 wherein several designs of diaphragms and contacts are described in view of their use of make, break or change-over contact. Further it is known to use permanent magnets for relays in order to achieve a magnetic adherence of the contacts after the removal of the control flux and/or to achieve a higher sensitivity of the relay. A magnetic latching relay of this kind is described e.g. in Swiss Pat. No. 498 482. In polarized relays for the reception of telegraphy signals permanent magnets were used for decades for improving the sensitivity.

Many of the above described relays of the prior art have the disadvantage that they cannot be mounted on printed circuit boards due to their size and almost all of these known relays have the disadvantage that they cannot be controlled directly by the low power output signals of conventional logic circuits. Further there are used basically different structures for different functions.

SUMMARY OF THE INVENTION

The electromagnetic miniature relay according to the present invention is characterized in that in the outer magnetic circuit there is provided at least one permanent magnet, the magnetic circuit of which is closed via the coil core only, the switching-over of the relay contacts being performed by producing an electromagnetic flux in the coil core with a direction opposite to that of the permanent magnetic flux.

It is therefore an object of the present invention to provide a family of electromagnetic miniature relays all of which are based on the same structure and have a size comparable with that of integrated circuits used in the logic circuits and which may be controlled directly by the usual output signals of logic circuits.

Other objects and advantages of the present invention will become apparent with reference to the accompanying drawings and detailed description thereof, wherein:

DESCRIPTION OF THE PREFERRED EMBODIMENT

Figure 1:
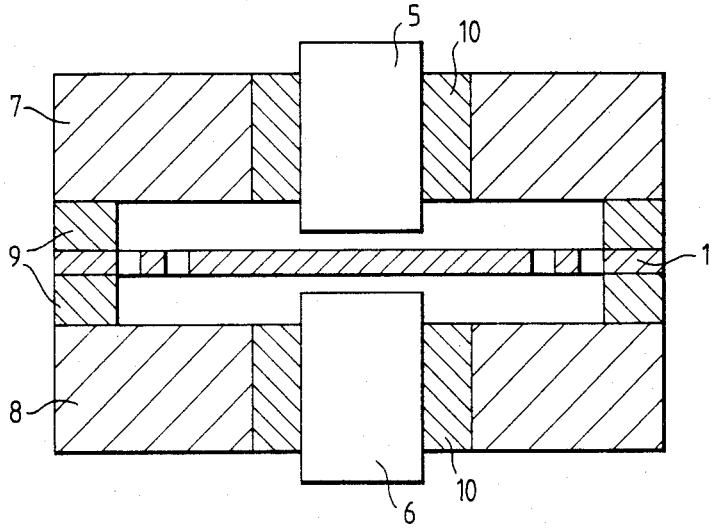
Fig. 1. PRIOR ART
FIG. 1 shows a section through a contact unit which may be used in all relays incorporating the present invention.

A contact unit known in the prior art will now be described in connection with FIGS. 1 and 2 for the understanding of the improvement obtained by the present invention. The contact unit comprises a circular diaphragm 1 of electrically conducting ferromagnetic material including a border zone 2, a spring zone 3 and a contact zone 4. The border zone 2 of the diaphragm 1 is connected via spacers 9 with pole rings 7 and 8, this connection being preferably made by welding. In the center of each pole ring 7 and 8 there is arranged a ferromagnetic rod or contact pole 5 and 6, respectively, which is connected via a glass-to-metal seal 10 to the corresponding pole ring. Instead of the glass-to-metal seal 10 there could also be used a ceramic-to-metal seal. The diaphragm 1 is the movable contact and the two poles 5 and 6 are the fixed contacts of a switching-over contact. The surfaces of the contact making portions of the diaphragm and the poles can be designed according to their function, e.g. they can be provided with a precious metal plating.

Figure 2:
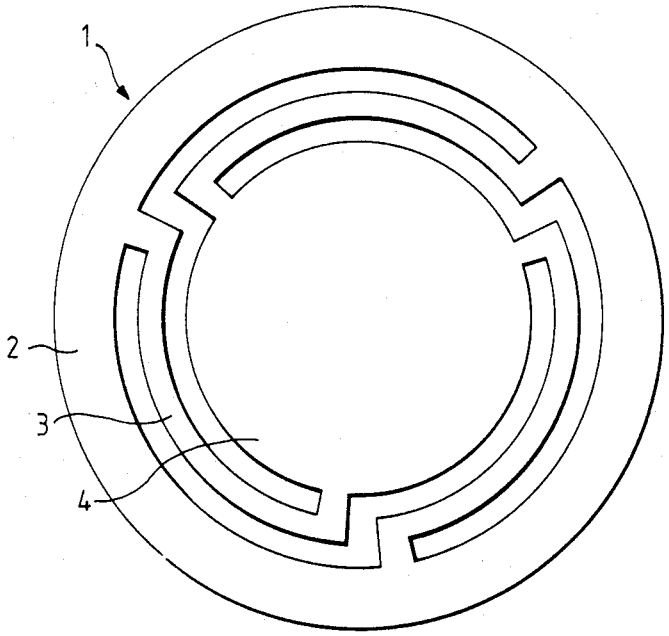
Fig. 2. PRIOR ART
FIG. 2 shows a diaphragm used in the contact unit illustrated by FIG. 1.

The diaphragm 1 may be arranged in the mid-position between the two poles, as shown in FIG. 1, but the spacers could also have different heights so that the diaphragm of a contact unit free from magnetic forces can be closer to one or the other pole so that during the operation different spring forces for the two contact positions result. The spacers can be so designed that the diaphragm lies in the rest position on one pole with a certain pressure so that the break contact of a switching-over contact results.

Since the diaphragm, the spacers and the pole rings are welded together and the pole rings are connected via glass-to-metal seals to the corresponding poles there results a hermetically sealed contact cavity which may be either fully evacuated or filled with a gas of desired composition. Due to its shape and size in the following the contact unit is called contact pill.

Figure 3A:
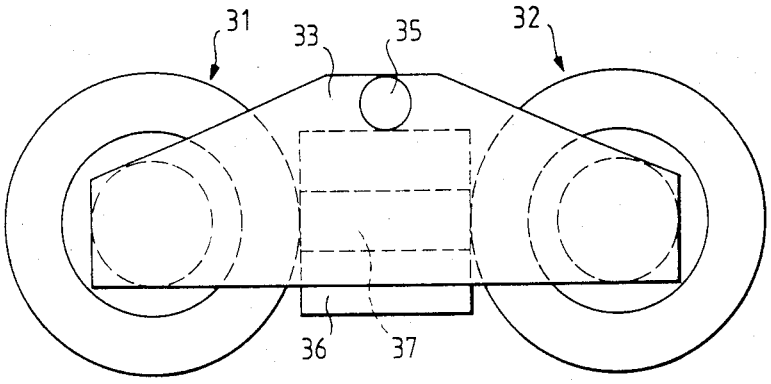
FIG. 3*a* shows a plan view of a bistable relay having two switching-over contacts.
Figure 3B:
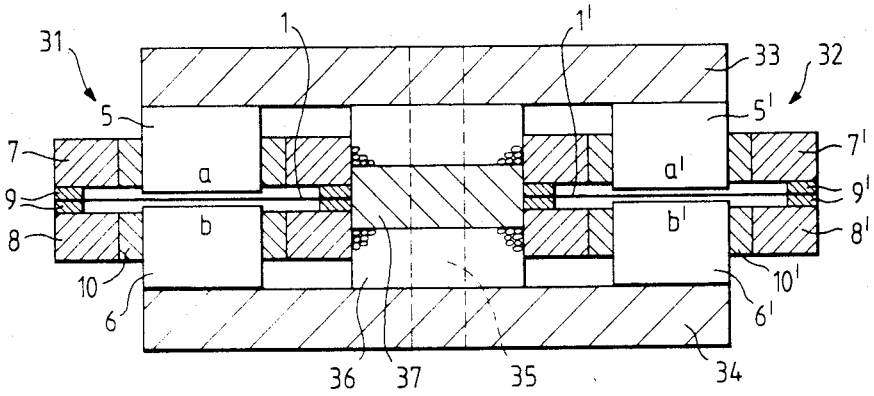
FIG. 3*b* shows a sectional view of a relay according to FIG. 3*a;*

FIGS. 3*a* and 3*b* show the basic structure of a bistable relay in accordance with the present invention having two switching-over contacts. The relay comprises two contact pills 31 and 32 having a structure according to that shown in FIGS. 1 and 2 and their piece parts carrying for pill 31 the same reference numerals as in FIGS. 1 and 3 and for pill 32 the same reference numerals with the addition of a prime. In addition thereto the contact between diaphragm 1 and pole 5 is referenced with a and that between diaphragm 1 and pole 6 with b for pill 31 whereas the corresponding contacts of pill 32 are referenced with a′ and b′.

The poles 5 and 5′ of the contact pills 31 and 32, respectively, are magnetically, but not electrically interconnected by a yoke 33 of ferromagnetic material. In the same manner the poles 6 and 6′ are interconnected by a yoke 34. The pole rings 7 and 8 of contact pill 31 are also magnetically interconnected with pole rings 7′ and 8' of contact pill 32 via a ferromagnetic core 37 of a drive coil 36. A permanent magnet 35 is connected to yokes 33 and 34 in such a manner that each of its poles lies upon one of said yokes.

Following is a description of the mode of operation of said bistable relay. From the state of art it is known that the contact making of a relay having diaphragm contacts is achieved by the magnetic attraction of the contact portion of the ferromagnetic diaphragm to a pole being designed as a contact probably supported by the magnetic repulsion of the counter pole. For the description it is assumed that the north pole of the permanent magnet 35 is at the side of yoke 33 and its south pole at the side of yoke 34. It can be seen that only two stable contact positions do exist, namely:

(a) Contacts a and b' closed. The magnetic flux flows from the north pole of permanent magnet 35 via yoke 33, pole 5, contact a, diaphragm 1 to pole rings 7/8, through coil core 37 to pole rings 7'/8', via diaphragm 1', contact b', pole 6' to yoke 34 and to the south pole of permanent magnet 35.

(b) Contacts b and a' closed. The magnetic flux flows from the north pole of permanent magnet 35 via yoke 33, pole 5', contact a', diaphragm 1' to pole rings 7'/8', through coil core 37 to pole rings 7/8, via diaphragm 1, contact b, pole 6 to yoke 34 and to the south pole of permanent magnet 35.

Other steady state contact positions are not possible as the magnetic loop for the flux of permanent magnet 35 has to be closed. The switching-over from one contact position into the other one is achieved by producing with the aid of control coil 36 a flux of such magnitude and polarity to compensate for the flux of permanent magnet 35 flowing through the coil core.

Assuming the initial condition (a) mentioned above the flux of permanent magnet 35 flows from pole rings 7/8 through coil core 37 to pole rings 7'/8'. To produce a switching-over coil 36 has therefore to produce a flux in the opposite direction, i.e. from pole rings 7'/8' to pole rings 7/8 producing a north pole at 7/8 and a south pole at 7'/8' which face the north pole of permanent magnet 35 at yoke 33 (air gap a+a') and its south pole at yoke 34 (air gap b+b') in such a way that repulsion will take place between diaphragm 1 and pole 5 and also between diaphragm 1' and pole 6' and attraction between diaphragm 1 and pole 6 and also between diaphragm 1' and pole 5' causing the relay to flip over. As soon as diaphragm 1 has crossed the mid-position it can be seen that a switching-over of the magnetic circuit for the flux of permanent magnet 35 takes place whereafter the magnetic fluxes caused by drive coil 36 and by permanent magnet 35 flow in the same direction through coil core 37 so that their strengths are added to close the contact into the new position (in this example position (b)). The current through the coil can now be switched off without the new contact position changes. A description of the switching back into position (a) is deleted since it happens in an analogous manner.

In the rest condition, i.e. with switched-off coil 36 the contact pressure between diaphragm 1 and the corresponding pole is determined by the attraction force caused by the flux of permanent magnet 35 minus the spring force of diaphragm 1 because contact zone 4 thereof is no longer in the mid-position between poles 5 and 6 causing an elastic deformation of spring zone 3. The spring force of zone 3 of diaphragm 1 contributes to the increase of sensitivity of the relay since the flux of the drive coil 36 has to produce an attraction force exceeding the contact pressure only by a small amount. During the second phase of the switching-over procedure, i.e. when the diaphragm has crossed the mid-position between the poles, the fluxes of permanent magnet 35 and of drive coil 36 are added, as already mentioned, so that a force is provided sufficient to deform spring zone 3 of diaphragm 1 in the opposite direction prior the current through the coil is switched off. The same is true for diaphragm 1' and the corresponding poles 5' and 6'.

Since the two contact pills are magnetically series-connected there is a magnetic coupling of the two switching-over contacts so that one switching-over contact can be used for monitoring the other one which is desired sometimes for bistable latching relays. Even if the monitored contact remains in one of its positions due to a failure the monitoring contact goes into the position corresponding to the actual position of the monitored contact as soon as the control signal is switched off.

The above description concerned the mode of operation of a bistable polarized relay. With the same principles other relay functions can be realized which will be described in connection with FIGS. 4–6 each showing a sectional view of a relay, similar parts being provided with the same reference numerals as in the previous figures, the plan view could be similar to that of FIG. 3*a*.

Figure 4:
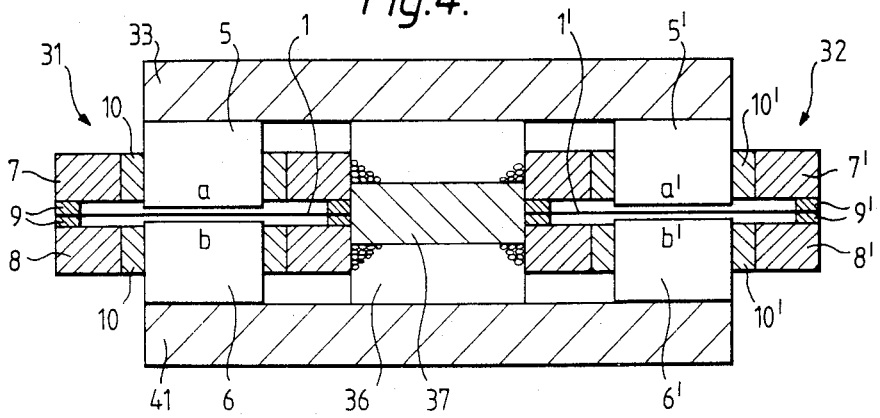
FIG. 4 shows a sectional view of a monostable relay having two switching-over contacts.

FIG. 4 shows a monostable relay in accordance with the present invention with permanent magnet and two switching-over contacts. This relay has the same structure as that shown in FIG. 3 with the exception that permanent magnet 35 arranged in FIG. 3 between yokes 33 and 34 has been deleted and that ferromagnetic yoke 34 has been replaced by a permanent magnetic yoke 41. In the rest condition the contacts b and b' are closed. If the north pole of permanent magnet 41 lies on pole 6 the following path for the magnetic flux results: North pole of permanent magnet 41, pole 6, diaphragm 1, pole rings 7/8, coil core 37, pole rings 7'/8', diaphragm 1', pole 6', south pole of magnet 41. When the drive coil is excited and the flux thereof exceeds the permanent magnet flux by a small amount the diaphragms 1 and 1' flip into their respective other positions and the make contacts a and a' are closed. The following path for the flux of the drive coil results therefrom: coil core 37, pole rings 7/8, diaphragm 1, pole 5, yoke 33, pole 5', diaphragm 1', pole rings 7'/8', coil core 37. After the current through the coil has been switched off the permanent magnet flux causes the reclosing of the break contacts b and b'.

Figure 5:
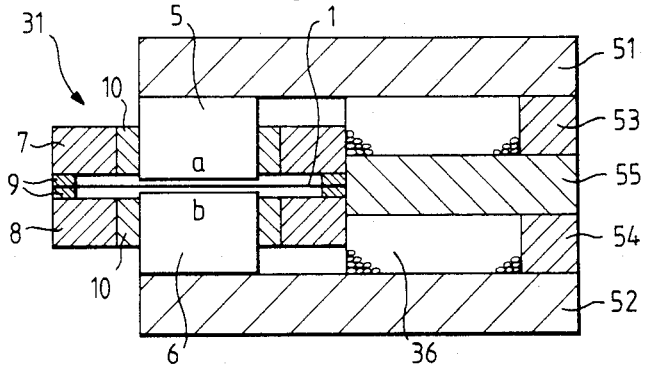
FIG. 5 shows a sectional view through a bistable relay having a single switching-over contact.

FIG. 5 shows a bistable relay including a permanent magnet and being provided with a single switching-over contact. Unlike the relay according to FIG. 3 there is provided a single contact pill 31. Since this is again a bistable relay a particular magnetic loop for the permanent magnet flux must be provided for each of the two contact conditions. For this reason the two poles 5, 6 are each interconnected via yokes 51, 52 of ferromagnetic material with the opposite poles of two permanent magnets 53, 54. The other poles of magnets 53, 54 are connected to core 55 of the drive coil 36 in a magnetically conducting manner. In each of the two contact positions the magnetic loop is closed for one of permanent magnets 53, 54 and open for the other one.

In place of the two permanent magnets 53 and 54 a single permanent magnet could be provided having its mid-position connected to core 55 in order to achieve the same effect.

Figure 6:
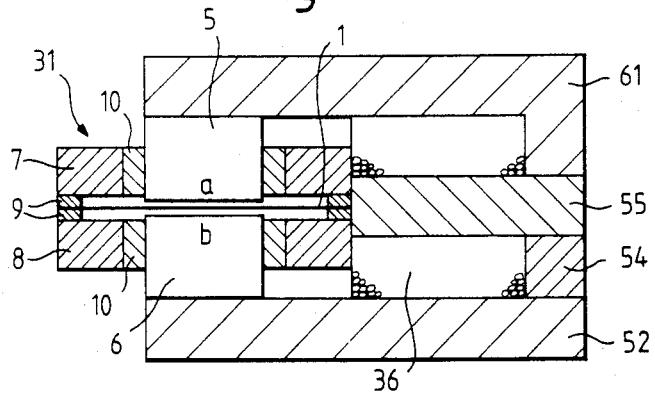
FIG. 6 shows a sectional view through a monostable relay having a single switching over-contact.

FIG. 6 shows a monostable relay including a permanent magnet and being provided with a single switching-over contact. The structure is similar to that of FIG. 5, but the series-connection of yoke 51 and permanent magnet 53 of FIG. 5 is replaced by a single yoke 61 made of ferromagnetic material. When drive coil 36 is not excited there results exactly the same magnetic loop for the permanent magnet flux as for the relay of FIG. 5 in the case of contact b being closed. When drive coil 36 is excited the magnetic loop for the electromagnetic flux of core 55 is closed via pole rings 7/8, diaphragm 1, pole 5 and yoke 61. The same effect could be achieved if the permanent magnet 53 of FIG. 5 were replaced by a corresponding piece of ferromagnetic material.

Since the present relays have very small dimensions and no movable parts with the exception of the diaphragms contained within hermetically sealed contact pills these relays can be moulded into standard DIL-packages like integrated circuits. The contact pills and the drive coil have to be connected to corresponding terminals.

The hereinbefore described relays of the present invention provide a family of relays all using the same hermetically sealed contact pill which may be evacuated or may be provided with a gas filling of desired composition. Contact breakthrough voltages of more than 1 kV can be achieved. Due to the use of a permanent magnet, the magnetic loop of which is closed only via the coil core, the relays need only a drive power of about 30 mW so that a direct control by the output signals of commercially available TTL-circuits is possible. Dual switch-over relays are provided with a magnetic coupling of the contacts. The diaphragms are the sole movable elements and have a very low mass leading to short switching and bouncing times and to a long life. The small size allowing to mount the relays into standard DIL-packages enables a space saving mounting of the relay together with integrated circuits on printed circuit boards.

What is claimed is:

1. An electromagnetic miniature relay having at least one hermetically sealed contact unit with a change-over contact, a movable contact including an elastic ferromagnetic diaphragm and fixed contacts including a pair of contact poles of ferromagnetic material mounted within spaced parallel pole rings by hermetically sealing and magnetically and electrically insulating connections, each of said contact poles extend from a different one of said pole rings toward each other and said diaphragm, said two pole rings and said diaphragm of said contact unit being connected with each other in a magnetically and electrically conducting manner and also with a coil core of a drive coil in a magnetically conducting manner, the magnetic circuit being closed via outer elements;

an outer magnetic circuit having at least one permanent magnet, the magnetic circuit of which is closed via said coil core only;

whereby the switching-over of the relay contacts is performed by producing an electromagnetic flux in said coil core with a direction opposite to that of the flux of said permanent magnet.

2. A relay according to claim 1 configured as a bistable relay having switching-over contacts, wherein two contact units are provided, with corresponding contact poles of the two contact units being interconnected via yokes of ferromagnetic material in a magnetically, but non-electrically conducting manner, and such that the permanent magnet comprises a bar magnet, the longitudinal axis of which is perpendicular to the main dimension of the two yokes and the poles of which are each connected with one of said yokes in a magnetically conducting manner, such that for each of the two steady state contact positions a magnetic loop for the flux of the permanent magnet is closed via a different path, the direction of said flux through the coil core in one contact position being opposite to that in the other contact position.

3. A relay according to claim 1, configured as a monostable relay having two switching-over contacts, wherein two contact units are provided with corresponding contact poles of the two contact units being interconnected by a yoke of ferromagnetic material and the two other contact poles being interconnected by a yoke of permanent magnetic material, both interconnections being made in a magnetically, but non-electrically conducting manner, such that with the non-excited drive coil, a magnetic loop for the flux of the permanent magnet is closed through the coil core causing the diaphragms to lie on one contact poles, and such that the excited drive coil closes another magnetic loop for the electromagnetic flux causing the diaphragms to lie on the other contact poles.

4. A relay according to claim 1 configured as a bistable relay having one switching-over contact, wherein one contact unit is provided having two contact poles each interconnected via ferromagnetic yokes with opposite poles of a permanent magnet in a magnetically, but non-electrically conducting manner, the center of the permanent magnet being connected to the coil core in a magnetically conducting manner, such that for each of the two steady state contact positions a magnetic loop for the flux of the permanent magnet is closed via a different path, the direction of the flux through the coil core in one contact position being opposite to that in the other contact position.

5. A relay according to claim 4, wherein the two ferromagnetic yokes are connected to opposite poles of two permanent magnets, and wherein the other poles of which are connected to the coil core in a magnetically conducting manner.

6. A relay according to claim 1 configured as a monostable relay having one switching-over contact, wherein one contact unit is provided, with one contact pole thereof being connected via a first yoke of ferromagnetic material to the coil core in a magnetically conducting manner, and the other contact pole being connected via a second yoke of ferromagnetic material with a pole of a permanent magnet in a magnetically conducting manner, the other pole of which is connected to the coil core in a magnetically conducting manner, such that with the non-excited drive coil a magnetic loop for the flux of the permanent magnet is closed through the coil core causing the diaphragm to lie on one contact pole and such that with the excited drive coil another magnetic loop for the electromagnetic flux is closed causing the diaphragm to lie on the other contact pole.

* * * * *